US005259134A

United States Patent [19]

Cohen

[11] Patent Number: 5,259,134

[45] Date of Patent: Nov. 9, 1993

[54] MERCHANDISING SYSTEM

[75] Inventor: Myles G. Cohen, Newtown, Conn.

[73] Assignee: Duracell Inc., Bethel, Conn.

[21] Appl. No.: 782,013

[22] Filed: Oct. 24, 1991

[51] Int. Cl.[5] ..... G09F 3/10

[52] U.S. Cl. ..... 40/299

[58] Field of Search ..... 40/299, 322; 211/59.1, 211/66; 248/220.4; 206/333, 806

[56] References Cited

U.S. PATENT DOCUMENTS

| | | | |
|---|---|---|---|
| 1,343,423 | 6/1920 | Todd | 211/59.1 X |
| 1,371,305 | 3/1921 | Hanney | 40/299 |
| 1,644,155 | 10/1927 | Scott | 211/59.1 X |
| 3,481,482 | 12/1969 | Wilkens | 248/200.4 X |
| 3,638,801 | 2/1972 | Larson | 211/59.1 X |
| 3,750,890 | 8/1973 | Smith et al. | 211/59.1 X |
| 3,799,357 | 3/1974 | Govang | 40/299 |
| 4,062,137 | 12/1977 | Herzog | 211/59.1 X |
| 4,166,532 | 9/1979 | Tsuchida et al. | 206/333 |
| 4,322,902 | 4/1982 | Lenthall | 40/322 |
| 4,624,396 | 11/1986 | Universe | 40/322 X |
| 4,660,723 | 4/1987 | Dechirot | 206/806 X |
| 4,896,770 | 1/1990 | Calcerano et al. | 206/333 |

*Primary Examiner*—Kenneth J. Dorner
*Assistant Examiner*—Milton Nelson, Jr.
*Attorney, Agent, or Firm*—Ronald S. Cornell; James B. McVeigh; Barry D. Josephs

[57] ABSTRACT

A merchandising system comprises an elongate hanger having a rear end adapted to be secured to a vertical surface such as a pegboard and a front end formed with a head having a periphery of a certain shape to identify a product to be hung on the hanger. The system further includes the identified product having a similarly shaped hanging opening at its upper end. The opening can be aligned with and made to receive and pass over the head so that the product can hang on its identifying hanger. Products having a different size or identity will not fit over the head because their openings are not similarly shaped.

6 Claims, 2 Drawing Sheets

MERCHANDISING SYSTEM

BACKGROUND OF THE INVENTION

1. Field of the Invention

This invention relates to merchandising systems. More specifically, this invention relates to a system in which a number of related but different size products are hung from respective hangers in a planogram at a retail outlet. Still more specifically, the invention relates to such an arrangement in which it is important that the proper products are stocked on the proper hangers.

In retail outlets it is common to suspend products in transparent packages such as blister packs—that is, in transparent plastic housings backed by a stiff card with a hanging opening in its upper end—from hangers which are supported on vertical pegboards. The hangers are typically made of wire bent into an elongated U-shape with the legs of the "U" having upward horns which engage into openings in the pegboard, the ends of the horns pressing forwardly against the rear surface of the pegboard to support the hangers in cantilever fashion. Products in blister packs are then suspended on the hangers which pass through the openings in the respective cards.

It is often the case in a retail outlet that a number of proximate hangers are provided with the intention that packs carrying different size items be suspended respectively from the hangers. It happens, however, that stock persons are not reliably conscientious about seeing that the blister packs are stored on the intended hangers for the respective sizes. Thus, dry cell batteries, for instance, which come in different sizes, (e.g. "C", "D", "AA" and "AAA") will be hung in various indiscriminate arrangements. For instance, "AA" battery packs may get hung on the "D" size battery pack hanger just because the "AA" battery hanger is full and there is room on the "D" hanger and the stock person is too rushed or lazy to take the overage back to the stockroom.

Subsequently, when a bunch of "D" size battery packs arrive, the stock person may see the "D" size rack is full and not unload the "AA"s from the "D" rack and fill up "D" size battery hanger as it should be. As a consequence, the bewildered customer is confronted with a "D" hanger full of "AA" battery size blister packs and has to assume that the store is out of "D" size batteries. Or he may simply buy the wrong size.

It also happens that when the battery pack hangers of a given brand become empty, battery packs of a rival manufacturer will find their way onto the hangers of the first brand, creating further customer confusion.

2. Description of Related Art including Information Disclosed under §§1.97 to 1.99

The prior art does not meet or satisfy this problem. In the prior art there are display hangers of the type described which are designed for use with pegboards, for instance, in which identifying indicia are provided on a separate support element above the hangers. Examples are:

U.S. Pat. No. 3,245,547 issued Apr. 12, 1966 to Felkay

U.S. Pat. No. 3,645,485 issued Feb. 29, 1972 to Gold

U.S. Pat. No. 4,783,033 issued Nov. 8, 1988 to Valiulis.

The art also includes hanger structures of the same general type as described, including anti-pivot means. An example is the disclosure in Schayer U.S. Pat. No. 3,070,339 which issued Dec. 25, 1962. The Wilkens U.S. Pat. No. 3,481,482 provides a pilfer-proof arrangement wherein the pack has a special opening and a special hook is provided at the front of the hanger so that the blister pack must be manipulated to remove it from the hanger.

Farther afield, in the area of laundry racks there are means by which tags attached to laundry items are apertured in a way that checks out with a shape of a element used to identify the owner of the laundry items. Thus, laundry tags are provided with shaped openings that fit onto shaped body members if they are to be correlated with the laundry identified by that body member. Examples of such arrangements are the old patents U.S. Pat. No. 1,343,423 which issued Jun. 15, 1920 to J. H. Todd and U.S. Pat. No. 1,644,155 which issued Oct. 4, 1927 to R. O. Scott. Such devices and arrangements, however, are of no help in considering the merchandising problem described above.

SUMMARY OF THE INVENTION

The present invention relates to a merchandising system comprising an elongate hanger having a rear end adapted to be secured to a vertical surface such as a pegboard and a front end, the front end being formed with a head having a periphery of a certain shape to identify to a stock person or a shopper a product to be hung on the hanger. The system further includes the identified product having a hanging opening at its upper end, the opening also having the certain shape.

In an embodiment of the invention the product can be aligned with and made to receive and pass over the head so that the product can hang on its identifying hanger. On the other hand, products having a different size or identity will not fit over the head because their openings are not similarly shaped.

Thus, the stock person will be forced into stocking the hangers with their proper respective size of product and will be unable to put products of a different size or a different manufacturer on the improper hangers because the openings in the different size or different manufactures's products do not fit over the head of the first manufacturer. Happily, the customer will not be bewildered by the indiscriminate stocking which in the past has been commonplace. The customer will see the proper size items on the proper hangers, the hangers clearly identifying to the shopper the products on that particular hanger.

All of this has the retailer as the beneficiary of a more orderly stocking, customers who can find at first try the precise product they are looking for without requiring the retailer's attention, and a readily apparent condition of the state of the displayed inventory.

BRIEF DESCRIPTION OF THE DRAWINGS

Further objects and features of the invention will be clear from a reading of the following specification and reference to the drawings, all of which shown non-limiting embodiments of the invention. In the drawings.

DESCRIPTION OF THE PREFERRED EMBODIMENTS

Figure 1:
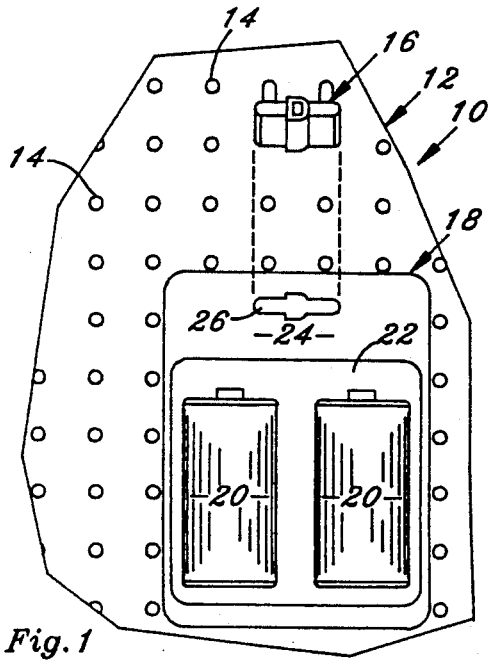
FIG. 1 is a front plan view of a section of a planogram pegboard having a hanger embodying the invention, and a blister pack with the opening in the blister pack aligned with the front of the hanger.

A system embodying the invention is generally designated 10 in FIG. 1. It comprises a pegboard 12 having the usual pattern of aligned holes 14. The system further includes the hanger generally designated 16 and the product generally designated 18.

The product 18 in the arrangement shown is a package of dry cell batteries 20 encased in the transparent housing 22 of a blister pack having the conventional backing card 24.

The blister arrangement may be as shown with the card on the back of the blister 22 or it may be a more symmetrical arrangement with an opening in the backing card, the batteries 20 on the plane of the card and blister housings 22 on the sides of the card to allow both sides of the batteries to be visible from the side. It is also envisioned that the blister pack can be a completely transparent housing having a double thickness panel extending up therefrom. In any event, whether it is a backing card, a central card or a transparent panel, the upper end thereof is formed with a hanger opening 26.

As is customary, the product is suspended on the hanger 16 by having the opening 26 pass through the front end of the hanger.

Figure 2:
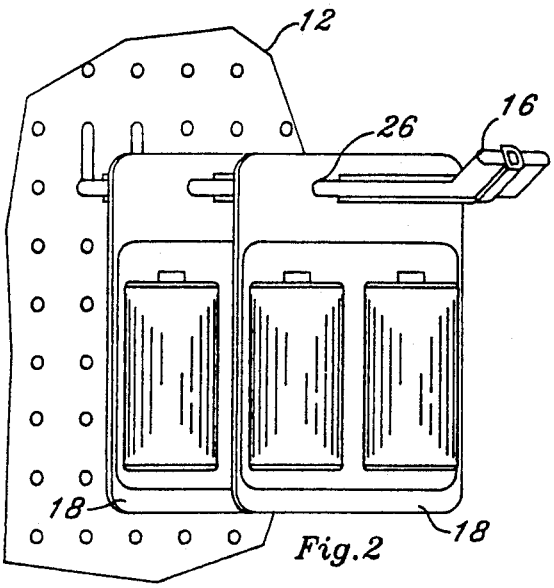
FIG. 2 is a perspective view similar to FIG. 1 with a pair of blister packs installed on the hanger.

FIG. 2 shows a pair of products 18 suspended from a hanger 16. Clearly the hanger 16 could be made to support a number of additional products, two being shown as exemplary.

Figure 3:
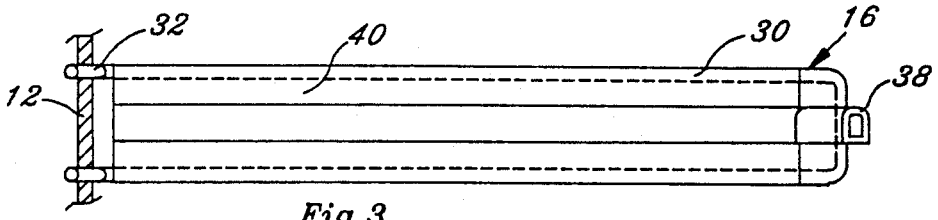
FIG. 3 is a top plan view showing a hanger embodying the invention installed on a pegboard.
Figure 4:
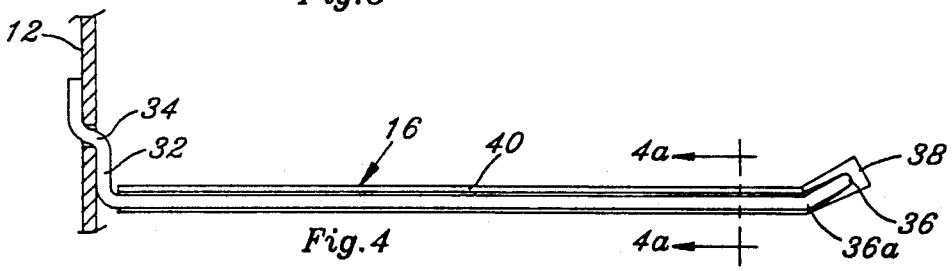
FIG. 4 is a side view.
Figure 4A:
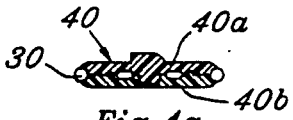
FIG. 4*a* is an enlarged section view taken on the line 4*a*—4*a* of FIG. 4.

Referring now to FIGS. 3 through 4*a*, the hanger 16 comprises, as is conventional, a U-shaped wire element 30. At the rear of the element, at the ends of legs of the "U" are respectively a pair of horns 32, each of which has the customary offset or dog leg 34 (FIG. 4) so that in use the horns pass through holes 14 of the pegboard and come to rest with the portions of the horns above the offset 34 bearing forwardly on the back of the pegboard and the portions of the horns below the offset 34 bearing rearwardly on the front of the pegboard 12 to support the hanger cantilever fashion. The front of the hanger 16 is tipped upwardly at 36*a*, also as is conventional, to avoid products being displaced forwardly off the hanger.

Referring to an essential element of the invention, attention is now directed to the head 38 of the hanger, formed, molded or otherwise secured to the front of the hanger 16. The periphery of the head 36 is in the shape of an indicia which serves to identify the product which is to be installed on the hanger. This identification is, of course, meaningful to the stock person who will see in the specific case involved that the hanger in question is to be stacked with "D" size batteries. It is also meaningful, however, to the shopper who is looking for a replacement "D" size battery and understands that batteries on this hanger are of "D" size.

It will be noted from FIGS. 1 through 4*a* in the examples shown that the top and bottom of the "D" extend above and below the confines of the front of the hanger. This is, of course, an important feature of the invention because the extensions of the head 38 in vertical dimensions beyond the levels of the top and the bottom of the hanger on either side (FIG. 4*a*) dictate the shape of the opening and will preclude the installation of the improper products on the hanger involved.

Figure 4B:
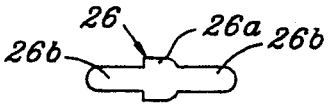
FIG. 4*b* is the outline of an opening to go with the FIG. 4*a* hanger.

Between the legs of the "U" of the hanger (FIG. 4*a*) is a filler 40. It comprises molded plastic halves 40*a* and 40*b* cemented together between the two legs of the U-shaped wire element 30. These halves together form the outline of the configuration of the head 38 so that the outline of the head in the preferred version extends all the way along the hanger. This affords particular assistance in the removal of the product from the hanger so that the card does not "catch" on the head as the card is withdrawn. The filler at the front of the hanger and the head may comprise a separate piece FIG. 4*b* is an outline of the opening 26. The central part 26*a* of the opening is shaped the same as the head 38 and the lateral extensions 26*b* are designed to accommodate the sides of the hanger 16 to either side of the head. Thus, in installing a product 18 on the hanger 16 the stock person will first align the central part 26*a* of the opening with the head 38 and pass the card over the head 38. From this point the sides of the hanger 16 are received through the lateral enlargement 26*b* and the proper product 18 is now installed on the hanger. Clearly, additional products may be installed until the hanger is full. In the removal of the products from the hanger 16, the card is drawn forwardly up the rise 36 at the front end of the bight (FIG. 4) so that lateral enlargements 26*b* move forward beyond the sides of the hanger and finally the opening 26*a* moves forward of the head 38 to free the card for purchase.

Figure 5:
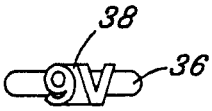
FIG. 5 is a view of a head of a hanger taken in the plane of the indicia and showing portions of the hanger extending rearward therefrom.
Figure 6:
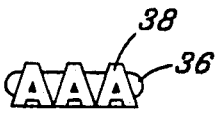
FIG. 6 is the view of a head of a different hanger taken in the plane in the indicia and showing portions of the hanger extending rearward therefrom.
Figure 5A:
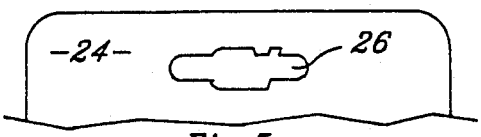
FIG. 5*a* is a fragmentary view of a blister pack backing card showing its opening to correspond with the head of FIG. 5.
Figure 6A:
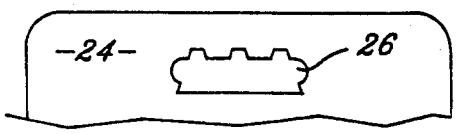
FIG. 6*a* is a fragmentary view of a blister pack backing card having an opening corresponding to the head of FIG. 6.
Figure 7:
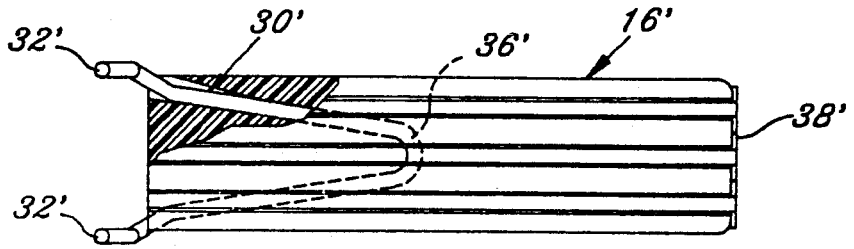
FIG. 7 is a top plan view of a hanger of modified form with a portion of the top broken away.
Figure 8:
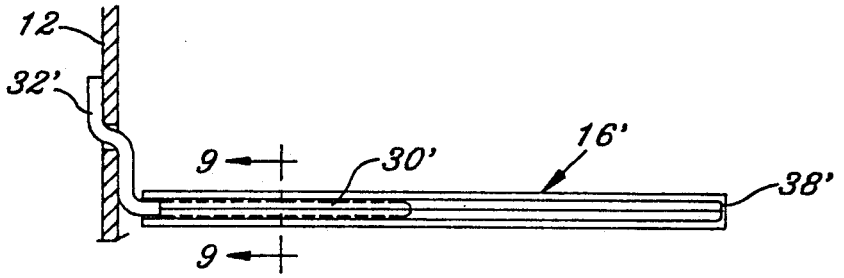
FIG. 8 is a side elevational view of the hanger of FIG. 7 installed on a pegboard.

FIGS. 5 and 6 show different heads representing both to the stock person and the shopper different sizes of batteries to be installed on the respective hangers (not shown). FIGS. 5*a* and 6*a* the hanger in FIGS. 5 and 6 respectively. Note that in FIG. 6*a* the indicia "AAA" of the head is so large as to virtually cover the entire width of the hanger. It should be understood that other indicia are similarly provided for "C" and "AA" batteries as well as others.

FIGS. 7 through 10 relate to a modified form of hanger 16'. In this form the U-shaped element 30' is foreshortened and more in the shape of a "V". It includes the bight 36' and the horns 32' shaped as in FIG.

Figure 9:
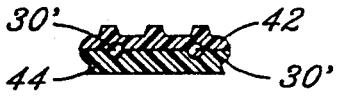
FIG. 9 is a sectional view taken on the line 9—9 of FIG. 8.
Figure 10:
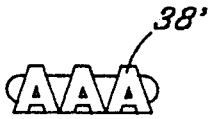
FIG. 10 is a view of the front end of the hanger of FIG. 8.

4. The hanger further comprises two molded plastic halves (FIG. 9) which are cemented together and which clamp the wire U-shaped element 30′ between them. The plastic halves comprise the upper plate 42 and the lower plate 44, the lower plate having molded recesses adapted to receive the legs and bight of the U-shaped element 30′. As in the earlier embodiment, the upper and lower surfaces of the plastic halves are formed with ribs which carry rearwardly the contours of the periphery of the indicia of the head (FIG. 9). FIG. 10 is a view of the front end of the embodiment of FIGS. 7 through 9.

Figure 11:
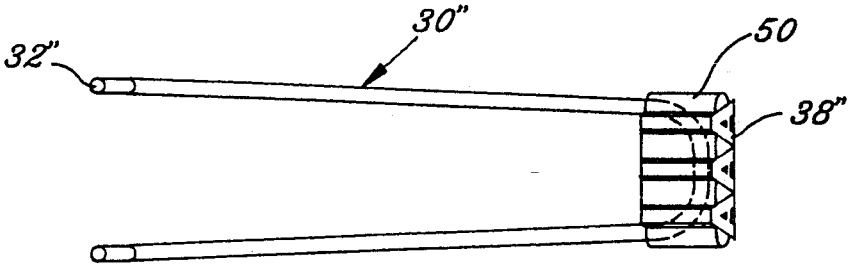
FIG. 11 is a top plan view of yet another modification of a hanger.
Figure 12:
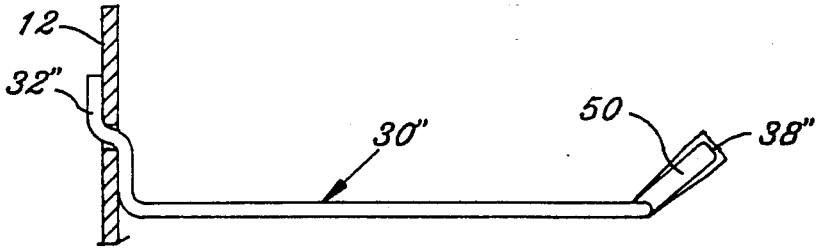
FIG. 12 is a side elevational view of the form of the invention shown in FIG. 11 installed on a pegboard.
Figure 13:
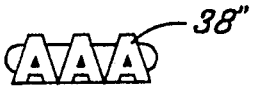
FIG. 13 is a view taken on the plane of the indicia of the head of FIG. 12.

A further embodiment of the invention is shown in FIGS. 11 through 13 wherein the wire U-shaped element 30″ is formed with the bight inflected upwardly (FIG. 12). At the front of this embodiment is a molded piece 50 which includes the head 38″ and a rearwardly and downwardly extending body which is fitted onto the bight of the U-shaped element 30″. As shown, and for convenience particularly in removing product, the body is formed with the contours of the periphery of the indicia of the head 38″. As shown, these rearward outlines may be tapered down to the thinness of the wire of the U-shaped element 30″. The embodiment shown in FIGS. 11 through 13 is employed in the same fashion as the other embodiments.

The rear of the wire element 30″ is formed with the horns 32″ as shown best in FIG. 12 and which engage the pegboard in similar fashion to those described so that the hanger is supported cantilever fashion.

In the embodiments disclosed herein the head and opening are described as having the shape of an indicia, that is, a letter, for instance, representing a size. Some of the benefits of the invention may be preserved in embodiments in which the head and opening are of a unique shape (e.g. a triangle or rectangle) with the symbolizing indicia merely lettered on the head. The indicia shape is, of course, preferred.

The invention thus described provides means for assuring that products are stocked properly on their respective hangers because the system forces the stock person to conscientiously install the proper product with the proper heads. The heads, of course, will thwart the introduction of the improper products because the openings in the improper products do not provide the proper outline for the head and the head will block their passage. As a result, the products are properly stocked and at a glance the customer can see and pick off the product that he wants by merely reading the head. Finally, the retailer himself can see that the hangers are properly stocked and which ones are in need of reordering.

Other embodiments of the invention are possible without departing from the spirit of the invention. Thus, while the invention has been shown in only a few embodiments, it is not so limited but is of a scope defined by the following claim language which may be broadened by an extension of the right to exclude others from making or using the invention as is appropriate under the doctrine of equivalents.

What is claimed is:

1. A merchandising display comprising, in combination: a plurality of packages each containing a product having indicia thereon as an identification, a support, and a plurality of hangers; each hanger having a first, rear end and a second, front end; each hanger being adapted to be held in said support at its rear end with the hangers engaging the support to maintain the hangers in substantially horizontal position; and each hanger having a head at its front end, with each head being shaped in the form of indicia, and at least one of the hangers of the merchandising display having a head shape which is different from the head shape of another of the said hangers; and each package having a hanging opening the shape of which corresponds to the shape of the indicia on the product contained therein; the shapes and sizes of the hanging openings being substantially the same as the shapes and sizes of the heads of said hangers; whereby the hanging opening on each package can be fitted over a similarly shaped head of a hanger so that each package will be supported on its proper hanger.

2. A merchandising display comprising, in combination: a plurality of packages each containing at least one battery having indicia thereon as identification, a support, and a plurality of hangers; each hanger having a first, rear end and a second, front end; each hanger being adapted to be held in said support at its rear end with the hangers engaging the support to maintain the hangers in substantially horizontal position; and each hanger having a head at its front end, with each head being shaped in the form of indicia corresponding to the indicia on said batteries, and at least one of the hangers of the merchandising display having a head shape which is different from the shape of another of the said hangers; each package having a shaped hanging opening; the shapes and sizes of the hanging openings being substantially the same as the shapes and sizes of the heads of said hangers and corresponding to the indicia on the batteries in the packages; whereby the hanging opening on each package can be fitted over a similarly shaped head of a hanger so that the packages will be supported on their proper hangers.

3. The merchandising display of claim 2 wherein each hanger is wider than its head and the opening in each package has lateral enlargements to accommodate the entire width of the hanger.

4. The merchandising display of claim 2 wherein each package has a backing card, with the hanging opening of each package being formed in said backing card; with each individual package containing at least one battery, and with all of the batteries in each individual package being of the same size as the other batteries in said individual package.

5. The merchandising display of claim 2 wherein, each hanger is of general U-shape having upward horns at the ends of the legs of the "U" with the bight of the "U" being inclined upward, and wherein each of the indicia shaped heads is of greater vertical dimension than the vertical dimension of the said bight.

6. The merchandising display of claim 5 wherein the support comprises an apertured board, and each hanger is supported with the horns at the ends of the legs of the "U" engaging in apertures in the board.

* * * * *